US008975825B2

(12) United States Patent
Hu

(10) Patent No.: US 8,975,825 B2
(45) Date of Patent: Mar. 10, 2015

(54) LIGHT EMITTING DIODE DRIVER WITH ISOLATED CONTROL CIRCUITS

(75) Inventor: Yuequan Hu, Morrisville, NC (US)

(73) Assignee: Cree, Inc., Durham, NC (US)

( * ) Notice: Subject to any disclaimer, the term of this patent is extended or adjusted under 35 U.S.C. 154(b) by 56 days.

(21) Appl. No.: 13/596,696

(22) Filed: Aug. 28, 2012

(65) Prior Publication Data

US 2013/0300310 A1 Nov. 14, 2013

Related U.S. Application Data

(60) Provisional application No. 61/644,018, filed on May 8, 2012.

(51) Int. Cl.
*H05B 37/02* (2006.01)

(52) U.S. Cl.
USPC ..... 315/239; 315/247

(58) Field of Classification Search
USPC ..... 315/239, 254, 247, 201, 210, 307, 297
See application file for complete search history.

(56) References Cited

U.S. PATENT DOCUMENTS 5,646,486 A 7/1997 Edwards et al.
5,786,992 A 7/1998 Vinciarelli et al.
7,609,008 B1 10/2009 Kohler
8,212,493 B2 * 7/2012 Melanson et al. ..... 315/247
2011/0109230 A1 5/2011 Simi
2012/0025733 A1 2/2012 Melanson

FOREIGN PATENT DOCUMENTS

WO WO 2008/064348 A2 5/2008

OTHER PUBLICATIONS

Notification of Transmittal of the International Search Report and the Written Opinion of the International Searching Authority, or the Declaration, PCT/US13/37166, Date of Mailing; Aug. 23, 2013; 11 pages.

* cited by examiner

*Primary Examiner* — Daniel D Chang
(74) *Attorney, Agent, or Firm* — Myers Bigel Sibley & Sajovec, P.A.

(57) ABSTRACT

A light emitting diode (LED) driver circuit that generates current for driving an LED load includes a voltage converter circuit configured to supply a drive current to the LED load in response to a control signal, a control circuit that generates the control signal, and a bias voltage generating circuit that generates the bias voltage for the control circuit. The bias voltage generating circuit is galvanically isolated from a power supply voltage and from the LED load. The voltage converter circuit regulates a level of the drive current supplied to the LED load in response to the control signal.

22 Claims, 10 Drawing Sheets

$$I_{LED_AVR} = I_{PK} \frac{T_{ON}}{T_{ON} + T_{OFF}}$$

LIGHT EMITTING DIODE DRIVER WITH ISOLATED CONTROL CIRCUITS

CROSS REFERENCE TO RELATED APPLICATION

The present application claims the benefit of and priority to U.S. Provisional Patent Application No. 61/644,018, filed May 8, 2012, entitled "Dimmable Light Emitting Diode Converter Circuit," the disclosure of which is hereby incorporated herein by reference in its entirety.

BACKGROUND

The present disclosure generally relates to LED drivers, and more particularly, to an LED driver with control circuits, such as dimming control circuits.

As a result of continuous technological advances that have brought about remarkable performance improvements, light-emitting diodes (LEDs) are increasingly finding applications in traffic lights, automobiles, general-purpose lighting, and liquid-crystal-display (LCD) backlighting. As solid state light sources, LED lighting is poised to replace existing lighting sources such as incandescent and fluorescent lamps in the future since LEDs do not contain mercury, exhibit fast turn-on and dimmability, and long life-time, and require low maintenance. Compared to fluorescent lamps, LEDs can be more easily dimmed either by linear dimming or PWM (pulse-width modulated) dimming.

A light-emitting diode (LED) is a semiconductor device that emits light when its p-n junction is forward biased. While the color of the emitted light primarily depends on the composition of the material used, its brightness is directly related to the current flowing through the junction. Therefore, a driver providing a constant current may be desired.

SUMMARY

A light emitting diode (LED) driver that generates current for driving an LED load is provided. The LED driver includes a voltage converter circuit that receives a power supply voltage and that supplies a drive current to the LED load in response to a control signal, a control circuit that generates the control signal, and a bias voltage generating circuit that generates a bias voltage for powering the control circuit. The bias voltage generating circuit is galvanically isolated from the LED driver. The LED driver may include both primary and secondary side circuits, and the bias voltage generating circuit may be galvanically isolated from both the primary and secondary side circuits of the LED driver.

The control circuit may be a dimming control circuit, and the control signal may be a dimming control signal.

The voltage converter circuit may include a transformer having a primary winding and a secondary winding, and the bias voltage generating circuit may include a tertiary winding coupled to the primary and secondary windings through mutual inductance.

The bias voltage generating circuit may include a diode having an anode coupled to a terminal of the tertiary winding and a bias capacitor coupled to a cathode of the diode, and a voltage induced in the tertiary winding in response to a change in current through the secondary winding may charge the bias capacitor through the diode to generate the bias voltage.

The voltage converter circuit may include a second capacitor coupled to an input voltage and the transformer may include an inductor coupled between the second capacitor and the primary winding of the transformer.

The LED driver circuit may further include a power factor correction (PFC) circuit including a PFC inductor, wherein the bias voltage generating circuit includes a bias winding coupled to the PFC inductor through mutual inductance, a diode coupled to a terminal of the bias winding, and a bias capacitor coupled to the diode. A voltage induced in the bias winding in response to a change in current through the PFC inductor charges the bias capacitor through the diode to generate the bias voltage.

The dimming control circuit may include a circuit coupled to the voltage converter circuit that regulates a level of the drive current supplied to the LED load in response to a dimming input signal. The dimming control circuit may include an opto-coupler that galvanically isolates the dimming control signal from the voltage converter circuit.

The dimming control circuit may be configured to generate a pulse-width modulated digital dimming control signal. In some embodiments, the dimming control circuit may be configured to generate an analog dimming control signal.

The LED driver circuit may further include an input configured to receive a power supply voltage and an occupancy sensor coupled to the dimming control circuit and configured to disconnect the input from the power supply voltage in response to an occupancy signal generated by the occupancy sensor.

Further embodiments provide a light emitting diode (LED) driver circuit that generates current for driving an LED load in response to a control signal. The LED driver circuit includes a voltage converter circuit that receives a power supply voltage and that supplies a drive current to the LED load in response to the control signal, a control circuit that generates the control signal and that is coupled to the voltage converter circuit, and a bias voltage generating circuit that generates a bias voltage for the control circuit. The dimming control circuit is galvanically isolated from both the voltage converter circuit and from the LED load.

The LED driver circuit may further include a power factor correction (PFC) circuit coupled between the power supply voltage and the voltage converter circuit.

The bias voltage generating circuit may be galvanically isolated from the rectified power supply voltage.

The bias voltage generating circuit may include a bias winding that is coupled to a magnetic component such as a transformer or an inductor in the DC to DC voltage converter circuit or the PFC circuit through mutual inductance.

The control circuit may be a dimming control circuit, and the control signal may be a dimming control signal. The dimming control circuit regulates a level of the drive current supplied to the LED load in response to the dimming control signal. The dimming control circuit may be optically isolated from the DC to DC voltage conversion circuit.

A solid state light emitting apparatus according to some embodiments includes a housing, an emitter board including an LED load including a plurality of solid state light emitting devices within the housing, and a driver circuit within the housing and coupled to the plurality of solid state light emitting devices and configured to receive a power supply signal and to generate current for driving plurality of solid state light emitting devices in response to a control signal. The driver circuit includes a voltage converter circuit that supplies a drive current to the LED load, a control circuit coupled to the voltage converter circuit and configured to generate the control signal that regulates a level of the drive current supplied to the LED load, and a bias voltage generating circuit that generates a bias voltage for the control circuit. The bias voltage generating circuit is galvanically isolated from the driver circuit.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Embodiments of the present inventive concepts are directed to light emitting diode (LED) driver circuits with dimming control circuits that require auxiliary power. Some embodiments provide circuits that generate auxiliary power and a dimming control signal that are galvanically isolated from an input power source and the output of the LED driver circuit.

Figure 1:
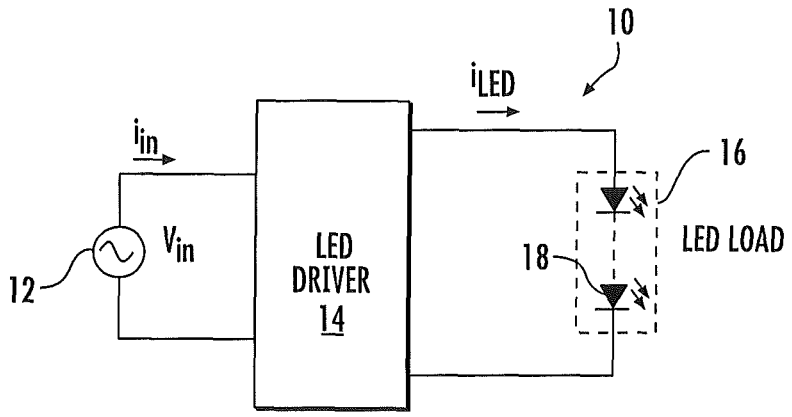
FIG. 1 is a schematic block diagram of a solid state lighting apparatus according to some embodiments.

In general, LED driver circuits are used to provide electric current to power LEDs and LED arrays. FIG. 1 is a schematic circuit diagram of a solid state lighting apparatus 10 that includes a power source 12, a driver circuit 14 which provides a constant current $i_{LED}$ and a solid state load 16 including a string of series-connected light emitting diodes (LEDs) 18. The solid state load 16 can include multiple LED strings that are connected in parallel. Depending on the performance and cost requirements, the LED driver circuit 14 can include multiple driver stages, each of which may perform a desired function, such as filtering, rectification, DC-DC conversion, power factor correction, etc.

Examples of solid state lighting apparatus that include driver circuits are shown in U.S. patent application Ser. No. 13/435,783, entitled "Lighting Module", filed Mar. 30, 2012, and U.S. patent application Ser. No. 13/176,827, entitled "Lens and Trim Attachment Structure for Solid State Downlights", filed Jul. 6, 2011 (P1437), the disclosures of which are incorporated herein by reference as if fully set forth.

Figure 2:
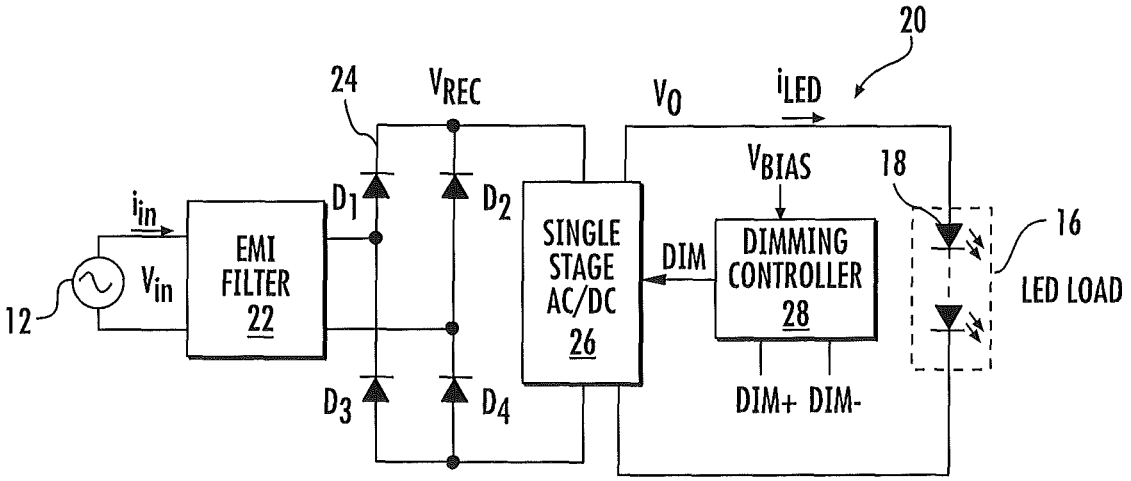
FIG. 2 is a schematic circuit diagram of a solid state lighting apparatus including a driver circuit having a single voltage conversion stage according to some embodiments.

FIG. 2 is a schematic circuit diagram of a solid state lighting apparatus 20 which includes a power source 12 that generates an AC input voltage $v_{in}$, an EMI filter 22, a bridge rectifier 24 including diodes $D_1$-$D_4$, a single-stage AC/DC converter circuit 26 that generates a constant driving current $i_{LED}$. The apparatus 20 further includes a dimming control circuit, namely, a dimming controller 28 that generates a dimming signal DIM that is used by the single-stage AC/DC converter voltage circuit 26 to regulate an aspect of the constant driving current $i_{LED}$, such as a level, average level, duty cycle, etc., of the constant driving current $i_{LED}$.

The dimming controller 28 operates in response to a dimming control input that is between DIM+ and DIM− and generates a dimming control signal DIM that is output to the voltage converter circuit 26.

The single-stage AC/DC voltage converter circuit 26 can also provide power-factor correction (PFC) or input-current shaping circuitry, that may force the input current to follow the shape of the input voltage waveform more closely, potentially resulting in less harmonic currents. The lower the current harmonic content is, the more real power is delivered to the load. The single-stage AC/DC converter circuit 26 may also provide galvanic isolation of the LED load 16 from the power source 12.

As is well known in the art, "galvanic isolation" occurs when two different sections of an electrical system are isolated to prevent current flow between the two systems. When two sections of an electrical system are galvanically isolated, there is no metallic conduction path between them. Energy or information can still be exchanged between the sections by other means, such as capacitance, induction or electromagnetic waves, or by optical, acoustic or mechanical means. Galvanic isolation may be used, for example, when two different sections of an electrical system need to communicate but are at different ground potentials, to prevent unwanted current from flowing between two sections of an electrical system sharing a ground conductor, for safety by preventing accidental current from reaching ground through a person's body, etc.

The single-stage AC/DC converter circuit 26 can be implemented as a flyback converter, which is commonly used due to its low-cost. The dimming controller 28 senses a dimming control signal between the voltages of DIM+ and DIM−, and outputs a dimming control signal DIM to the single stage AC/DC converter circuit 26. The single stage AC/DC converter circuit 26 then regulates the driving current $i_{LED}$ in response to the dimming control signal DIM.

Figure 3:
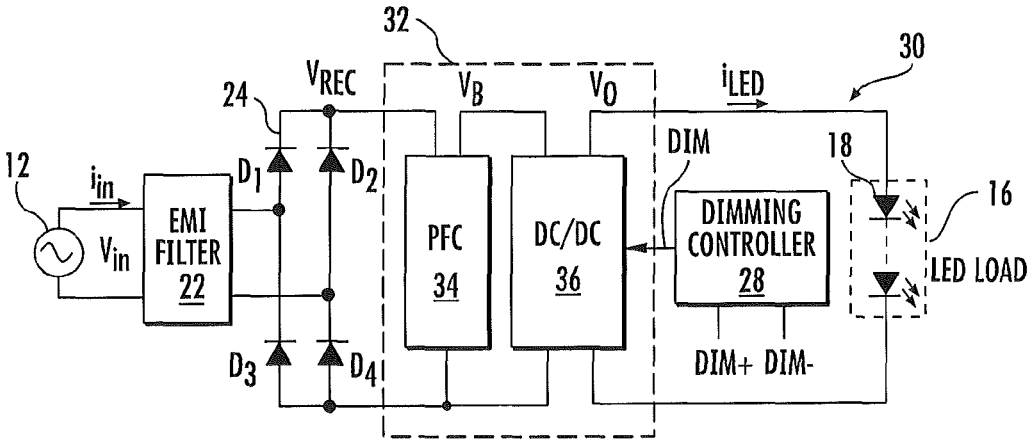
FIG. 3 is a schematic block diagram of a solid state lighting apparatus including a driver circuit having a power factor correction stage and a DC/DC conversion circuit according to some embodiments.

FIG. 3 is a schematic circuit diagram that illustrates a more complex driver circuit 30 that includes a two-stage converter circuit 32. The first stage 34 provides power-factor correction and the second stage 36 provides driving current regulation as well as galvanic isolation between the load 16 and the power source 12. Compared to the driver circuit 20 illustrated in FIG. 2, the driver circuit 30 illustrated in FIG. 3 can have lower ripple-current at twice the line frequency, which may avoid possible flickering.

Figure 4:
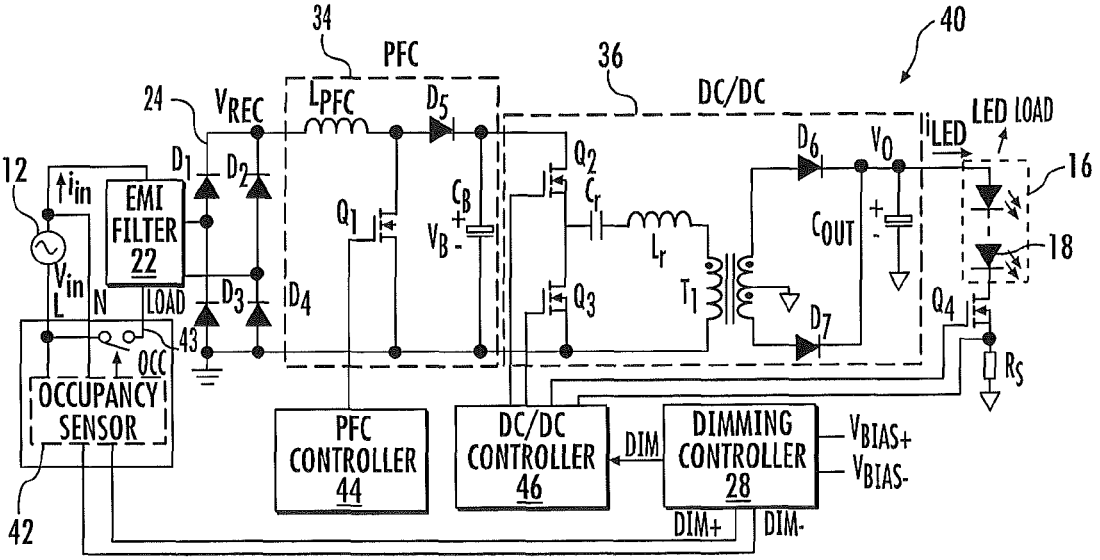
FIG. 4 is a schematic circuit diagram of a solid state lighting apparatus including a driver circuit having a power factor correction stage, a DC/DC conversion circuit, a dimming controller and an occupancy sensor according to some embodiments.

An example of an solid state lighting apparatus 40 with a two-stage driver 32 and dimming control incorporating an occupancy sensor 42 is shown in the schematic circuit diagram of FIG. 4. With an occupancy sensor 42, the solid state lighting apparatus 40 can be dimmed or completely turned off depending on the present condition of the occupancy sensor 42. In particular, an occupancy signal OCC may be generated by the occupancy sensor 42 in response to detecting a presence or absence of a person in proximity to the apparatus 40. A switch 43 connects or disconnects the EMI filter 22 to/from the voltage source 12 in response to the state of the occupancy signal OCC.

Referring to FIG. 4, the solid state lighting apparatus 40 includes an EMI filter 22 that is selectively coupled to an AC source 12 by the occupancy sensor 42. The output of the EMI filter 22 is rectified by a bridge rectifier 24 to generate a rectified voltage $V_{REC}$, which serves as the input voltage of the PFC stage 34.

The PFC stage 34 includes a PFC controller 44, an inductor $L_{PFC}$, a switch $Q_1$, a diode $D_5$, and a capacitor $C_B$ coupled as shown in FIG. 4. In response to selective switching of the switch $Q_1$ by the PFC controller 44, a DC voltage $V_B$ that is higher than the peak voltage of the input voltage $v_{in}$ is obtained across capacitor $C_B$. Therefore, this type of PFC converter is referred to as a boost PFC.

The second stage of the circuit is a resonant type DC/DC converter circuit 36, which includes a DC/DC controller 46, switches $Q_2$-$Q_3$, resonant capacitor $C_r$, resonant inductor $L_r$, transformer $T_1$, diodes $D_6$-$D_7$, and output capacitor $C_{OUT}$ coupled as shown in FIG. 4. The DC/DC stage 36 shown in FIG. 4 is a so called LLC resonant converter, with zero-voltage turn-on of switches $Q_2$-$Q_3$, and zero-current turn-off of diodes $D_6$-$D_7$ when the operating frequency is lower than the resonant frequency determined by $L_r$ and $C_r$. Therefore, the LLC converter may exhibit high efficiency and low EMI (Electro-magnetic Interference). Switch $Q_4$, which is coupled in series with the LED load 16, serves as a protection switch. When there is a short-circuit or over current, or over-voltage of the output, $Q_4$ is turned off to protect the driver circuit and the LED load 16. Resistor $R_s$ senses the LED current, and the DC/DC controller 46 uses the sensed current signal to provide current regulation of the LED load 18 and protect the driver circuit at faulty conditions. The dimming controller 28 is powered by a voltage source between $V_{BIAS+}$ and $V_{BIAS-}$. The DC/DC controller 46 and the PFC controller 44 are also auxiliary circuits that may require a bias voltage to operate.

Figure 5:
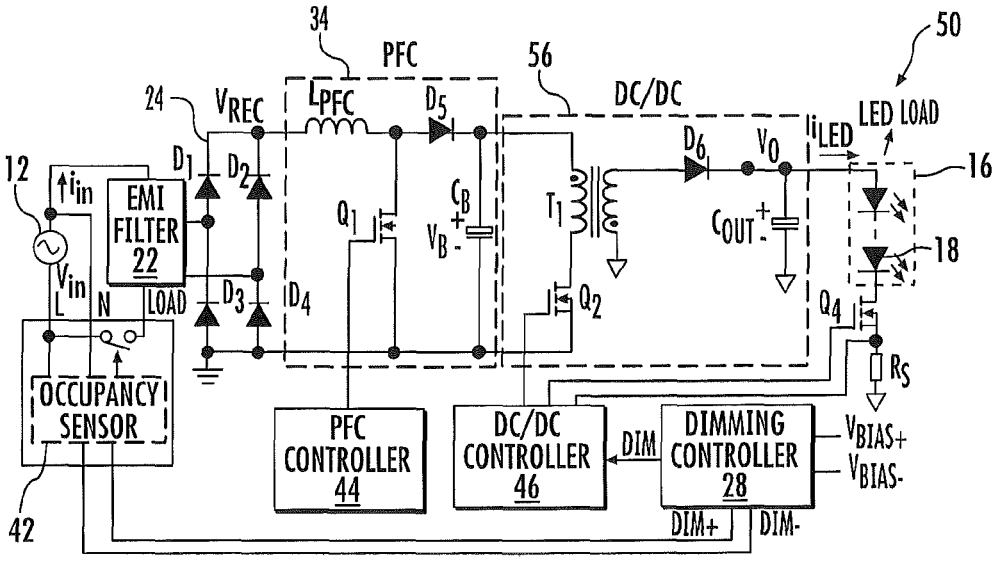
FIG. 5 is a schematic circuit diagram of a solid state lighting apparatus including a driver circuit having a power factor correction stage, a DC/DC conversion circuit, a dimming controller and an occupancy sensor according to further embodiments.

The DC/DC converter can be implemented using other types of converter circuits. For example, FIG. 5 shows a solid state lighting apparatus 50 that includes a flyback converter as the DC/DC converter circuit 56. The DC/DC converter circuit 56 includes a DC/DC controller 46 that controls a switch $Q_2$ that is coupled to a transformer $T_1$. The voltage $V_B$ is applied to the transformer $T_1$, and an output of the transformer $T_1$ is applied through a diode D6 to the output capacitor $C_{OUT}$.

Figure 6:
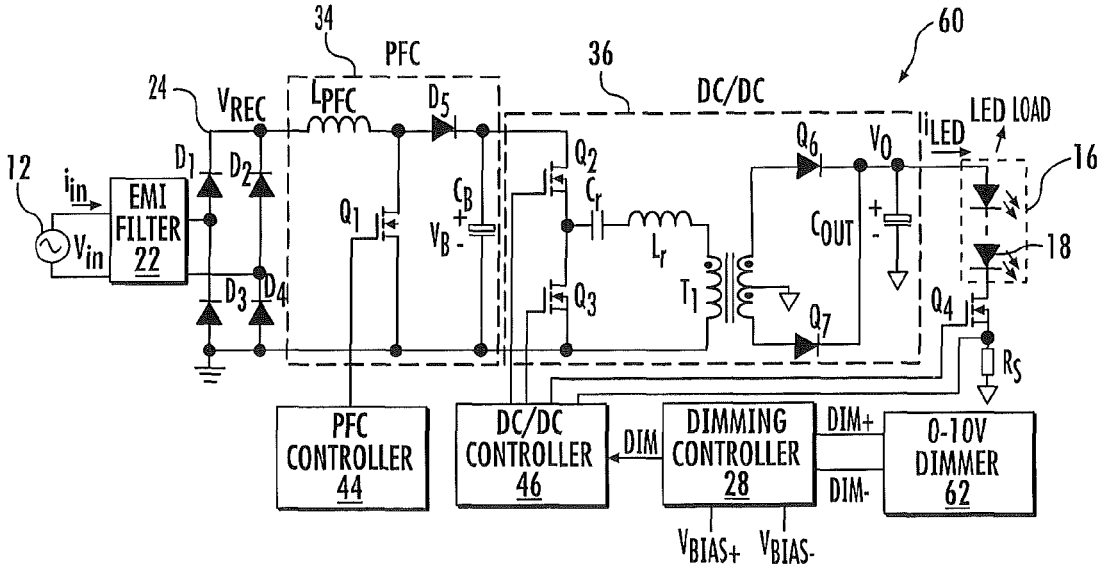
FIG. 6 is a schematic circuit diagram of a solid state lighting apparatus including a driver circuit having a power factor correction stage, a DC/DC conversion circuit, and a dimming controller according to further embodiments.

The dimming controller can be connected to a commercial 0-10V dimmer as shown in FIG. 6, which illustrates a solid state lighting apparatus 60 including a 0-10V dimmer 62. The 0-10V dimmer 62 generates a dimming control signal that is between 0 and 10 volts in response to a user input. The LED current, and thus the LED brightness, is adjusted based on the voltage appearing between DIM+ and DIM−. For example, the LED current is maximum providing full brightness when the voltage between DIM+ to DIM− is 10 V, whereas the LED current is half the maximum preset current and the brightness is half the full brightness when the voltage between DIM+ to DIM− is 5 V.

Figure 7:
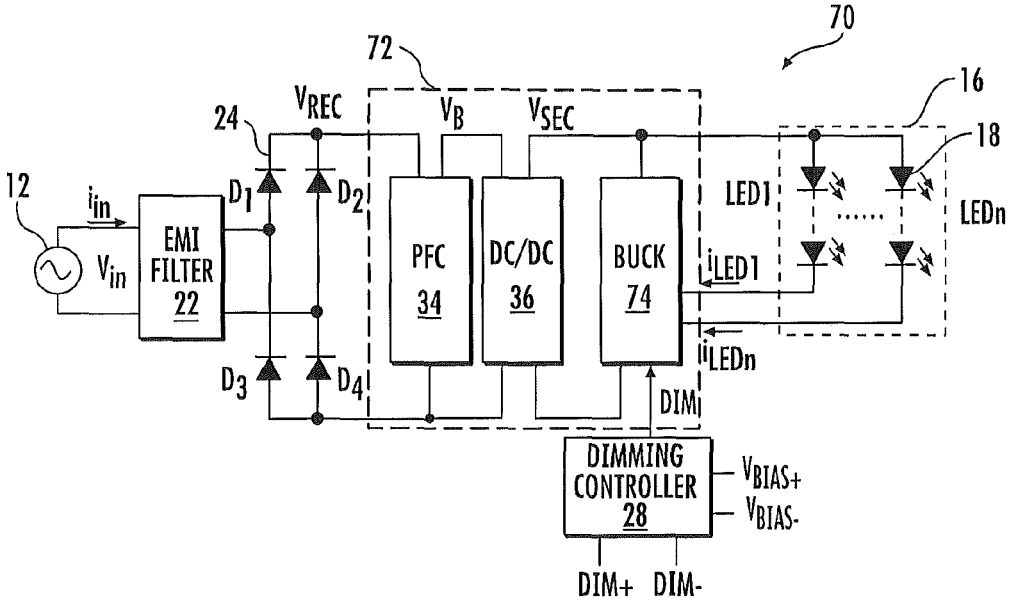
FIG. 7 is a schematic circuit diagram of a solid state lighting apparatus including a driver circuit having a power factor correction stage, a DC/DC conversion circuit, a buck converter circuit and a dimming controller according to further embodiments.

FIG. 7 illustrates a solid state lighting apparatus 70 including an LED driver circuit 72 with three stages of power processing. The LED driver circuit 72 includes a PFC stage 34, a DC/DC converter 36, and a Buck converter 74. The PFC stage 34 provides power-factor correction. The DC/DC converter 36 steps up/down voltage $V_B$ to voltage $V_{SEC}$, and provides galvanic isolation. The Buck converter 74 provides a constant current source for each of LED strings $LED_1$ to $LED_n$. The LED current and brightness can be adjusted based on dimming control signal DIM generated by the dimming controller 28.

Figure 8:
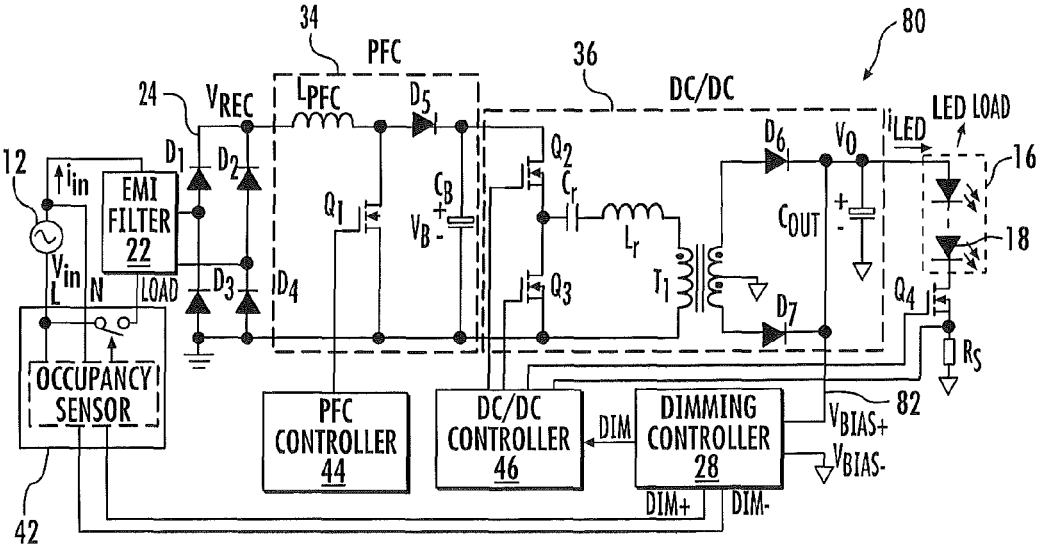
FIG. 8 is a schematic circuit diagram of a solid state lighting apparatus including a driver circuit having a power factor correction stage, a DC/DC conversion circuit, and a dimming controller according to further embodiments.

In order to operate, a dimming controller in an LED driver must be supplied with power in the form of a bias voltage. The bias voltage can be obtained directly from the output voltage $V_O$ as shown in FIG. 8. As shown therein, a solid state lighting apparatus 80 includes a DC/DC converter 36 implemented as an LLC resonant converter that generates an output voltage $V_O$. A line 82 draws the bias voltage $V_{BIAS+}$ from the output voltage $V_O$. However, since there is no galvanic isolation between the dimming controller and the secondary side circuit (i.e. the DC/DC converter 36), the noise generated by the ON/OFF action of diodes $D_6$ and $D_7$ in the DC/DC converter 36 may be coupled to the power source via the dimming controller 28 and the occupancy sensor 42, which may result in EMI problems.

Figure 9:
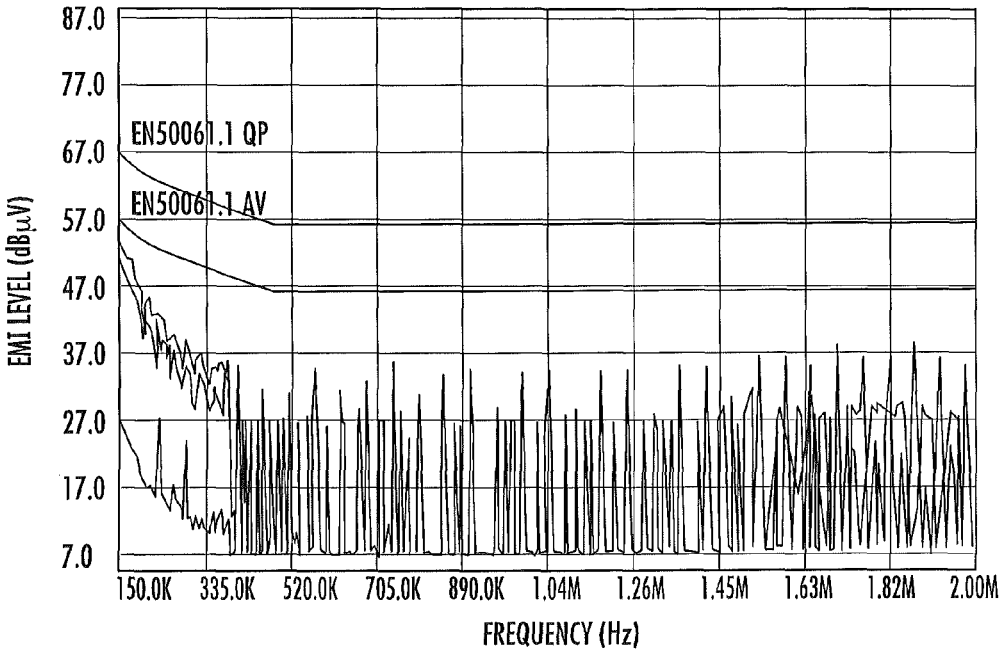
FIGS. 9 and 10 are graphs that show measured EMI levels for an LED driver circuit as shown in FIG. 8 without (FIG. 9) and with (FIG. 10) an occupancy sensor, respectively.
Figure 10:
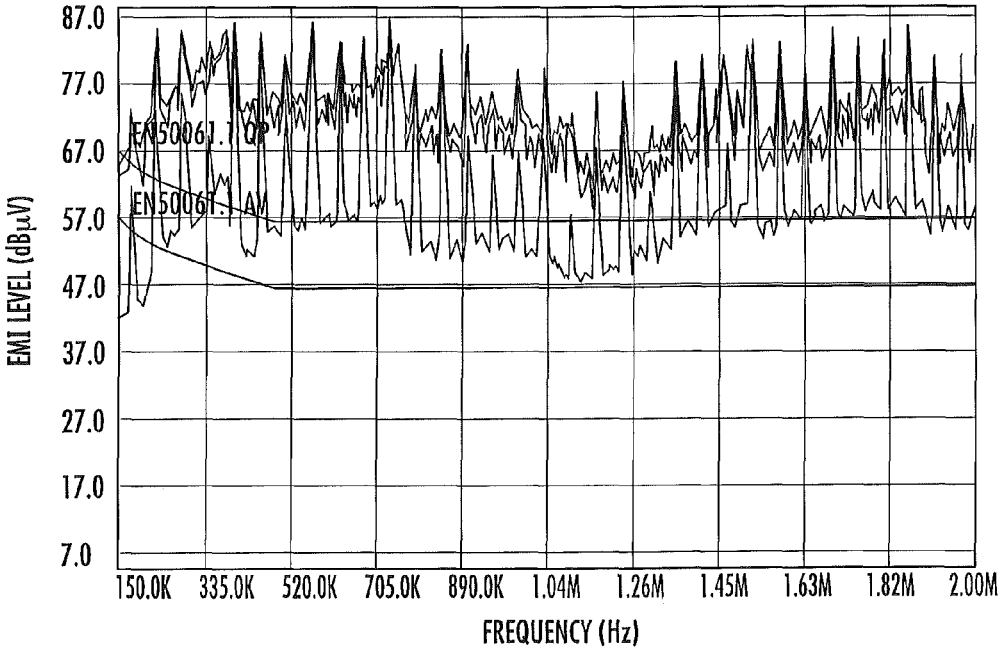

FIGS. 9 and 10 are graphs that show measured EMI levels for an LED driver circuit as shown in FIG. 8 without (FIG. 9) and with (FIG. 10) an occupancy sensor 42, respectively. In the driver, the bias power of the dimming controller is obtained from the secondary-side voltage $V_O$ with the same ground as shown in FIG. 8. Therefore, no galvanic isolation is provided. As can be seen from FIG. 10, the EMI level increases significantly when an occupancy sensor 42 is used. In fact, the EMI levels may be well above the acceptable threshold level set in the standards promulgated by the European Committee for Standardization (CEN), for the case with the occupancy sensor. A non-isolated dimming controller 28 can also cause safety issues when the dimming wires are wired in the same conduit as the power lines. Therefore, it may be desirable to provide a galvanically isolated bias power for the dimming controller 28.

Figure 11:
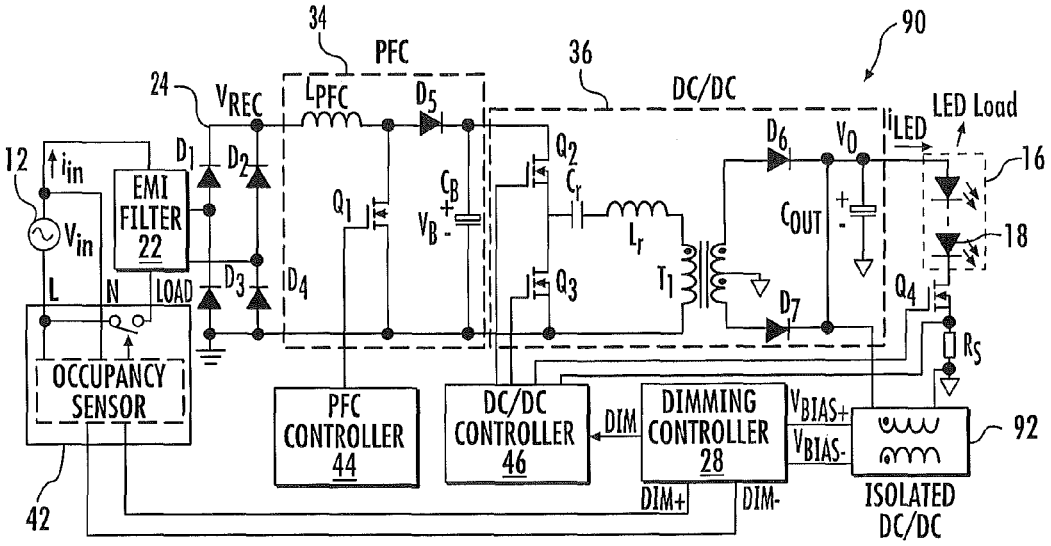
FIG. 11 is a schematic circuit diagram of a solid state lighting apparatus including a driver circuit having a power factor correction stage, a DC/DC conversion circuit, a dimming controller and an isolated bias generating circuit according to some embodiments.

FIG. 11 shows an example of a driving circuit for a solid state lighting apparatus 90 that has an isolated bias power. A bias generating unit 92 takes the output voltage $V_o$ of the LED driver circuit as the input, and converts it to a desired bias voltage for the dimming controller 28. The voltage source $v_{in}$ may also be used as the input voltage for the bias generating unit 92. However, an isolated stand-alone bias voltage generator, such as the bias generating unit 92 may need a voltage regulator including a controller, switches, diodes, magnetic components, capacitors, and other necessary components, which may add significant cost to the LED driver.

Embodiments of the present inventive concepts provide an LED driver that generates a galvanically isolated bias power that can be used to power auxiliary circuits, such as a dimming controller. That is, the bias power may be galvanically isolated from the input power source, which may reduce a level of electromagnetic interference generated by the LED driver circuit. It may be particularly desirable to galvanically isolate the dimming controller from the input power source, as the dimming controller has a direct role in determining the level of power output by the LED driver circuit. However, a galvanically isolated bias power signal may be used to power other circuits in the apparatus.

A bias power generating circuit may generate galvanically isolated bias power in a cost-effective bias power. In particular, some embodiments provide a driver circuit that provides a constant current for a light-emitting diode (LED) load, and a dimming control circuit that provides brightness control of the LEDs. The dimming controller is galvanically isolated from both the LED load and the power source.

Figure 12:
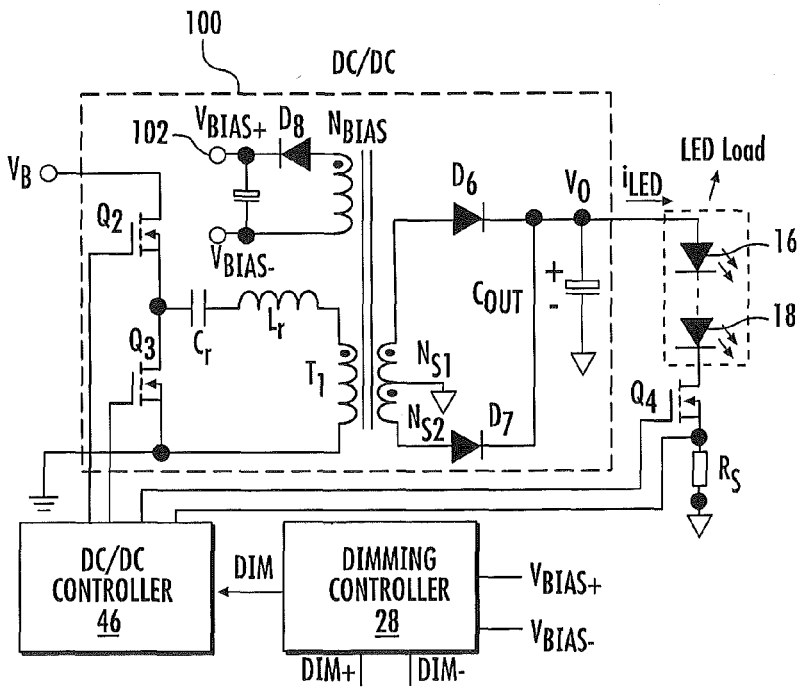
FIG. 12 is a schematic circuit diagram of a DC/DC conversion circuit including an isolated bias generating circuit according to some embodiments.

A DC/DC converter stage 100 of a driver circuit according to some embodiments is shown in FIG. 12 (the PFC stage is not shown in FIG. 12). The DC/DC converter stage 100 is configured to generate a galvanically isolated bias voltage having a value of ($V_{BIAS+}-V_{BIAS-}$) that can be supplied to the dimming controller 28 and/or other circuits of a light emitting apparatus.

The DC/DC stage 100 is a resonant LLC converter, including a DC/DC controller 46, switches $Q_2$-$Q_3$, resonant capacitor $C_r$, resonant inductor $L_r$, transformer $T_1$, diodes $D_6$-$D_7$, and output capacitor $C_{OUT}$. The transistor $T_1$ includes a primary winding coupled to the resonant inductor $L_r$ and secondary windings $N_{S1}$ and $N_{S2}$ coupled to the output capacitor $C_{OUT}$ through diodes $D_6$ and $D_7$.

A bias generating circuit 102 including bias winding $N_{BIAS}$, diode $D_8$, bias capacitor $C_{BIAS}$ is provided in the DC/DC stage 100 for generating a bias voltage ($V_{BIAS+}-V_{BIAS-}$) for the dimming controller 28. In particular, the bias winding $N_{BIAS}$ is configured as a tertiary winding of the transformer $T_1$, so that a voltage is induced in the bias winding $N_{BIAS}$ by a change in the level of current flowing through the secondary winding $N_{S1}$ (or $N_{S2}$) of the transformer $T_1$ through mutual inductance between the secondary winding $N_{S1}$ (or $N_{S2}$) and the bias winding $N_{BIAS}$. The voltage induced in the bias winding $N_{BIAS}$ is used to charge the bias capacitor $C_{BIAS}$ through the diode $D_8$. The bias voltage ($=V_{BIAS+}-V_{BIAS-}$) is taken from the terminals of the bias capacitor $C_{BIAS}$.

The operation of the bias power circuit is described as follows. As switch $Q_2$ is turned on, diode $D_6$ is forward biased by the voltage induced across secondary winding $N_{S1}$, which is the sum of output voltage $V_O$ and forward voltage drop of diode $D_6$, i.e., $v_{NS1}=V_O+v_{D6}$. In the mean time, a voltage is also induced across bias winding $N_{BIAS}$, thereby forward biasing diode $D_8$. This causes diode $D_8$ to conduct, and a current flows through $D_8$, charging bias capacitor $C_{BIAS}$ to a voltage which is equal to $v_{NS1}N_{BIAS}/N_{S1}$. Since bias winding $N_{BIAS}$ is not directly connected to any points of the primary-side (PFC) or secondary-side (DC/DC converter) circuits, the bias power for the dimming controller 28 is galvanically isolated from either side, which may result in less EMI coupling to the power source. Moreover, no separate voltage regulator may be needed, and the presence of only three extra elements in the bias generating circuit 102, namely, the bias winding $N_{BIAS}$, the diode $D_8$, and the capacitor $C_{BIAS}$, may result in lower additional costs.

Figure 13:
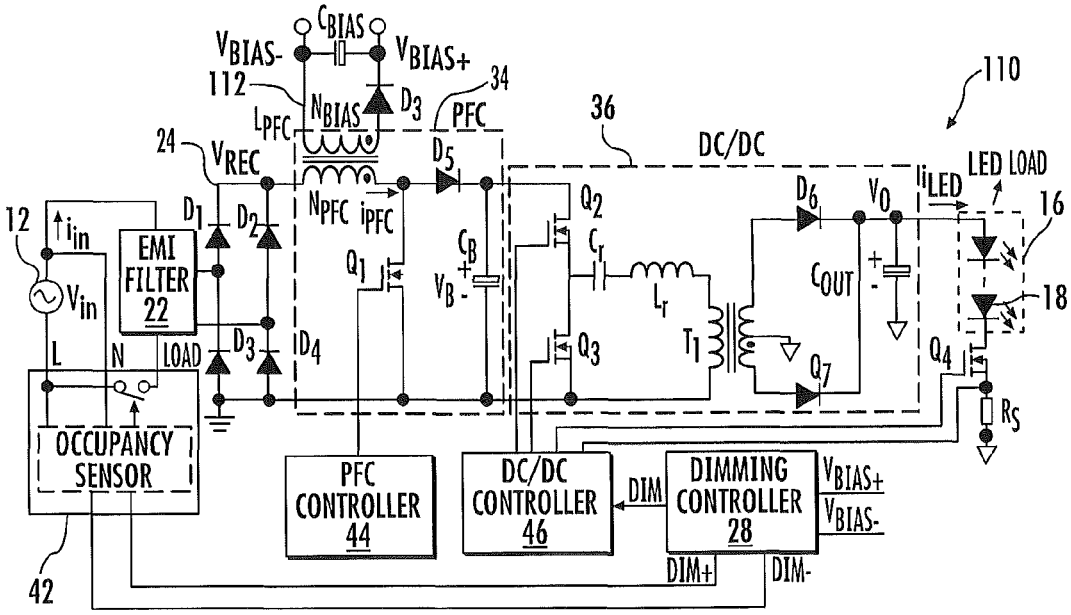
FIG. 13 is a schematic circuit diagram of a solid state lighting apparatus including a driver circuit having a power factor correction stage, a DC/DC conversion circuit, a dimming controller and an isolated bias generating circuit according to further embodiments.

FIG. 13 shows a driving circuit for a solid state lighting apparatus including a bias voltage generating circuit according to further embodiments. In particular, the solid state lighting apparatus 110 includes a driving circuit including an EMI filter 22, a bridge rectifier 24, a boost PFC converter 34, a DC/DC converter 36, a dimming controller 28 and an occupancy sensor 42.

A bias voltage generating circuit 112 includes a bias winding $N_{BIAS}$ coupled to the winding $N_{PFC}$ of PFC choke $L_{PFC}$ through mutual inductance. When switch $Q_1$ in the PFC converter 34 is turned on, current $i_{PFC}$ flows through the PFC choke $L_{PFC}$ and switch $Q_1$, and magnetic energy is stored in the PFC choke $L_{PFC}$. Current $i_{PFC}$ ramps up with a slope of $V_{REC}/L_{PFC}$. When switch $Q_1$ is turned off, a voltage is induced across winding $N_{PFC}$ of the PFC choke $L_{PFC}$, diode $D_5$ is forward biased and conducts, and current $i_{PFC}$ decreases with a slope of $(V_B-V_{REC})/L_{PFC}$, where $V_B$ is the voltage across capacitor $C_B$. In the mean time, bulk capacitor $C_B$ is charged, and diode $D_8$ is forward biased and conducts because of the voltage induced across winding $N_{BIAS}$, which is equal to $(V_B-V_{REC})N_{BIAS}/N_{PFC}$. Bias capacitor $C_{BIAS}$ is charged to a peak value of around $V_BN_{BIAS}/N_{PFC}$ when $V_{REC}$ is close to zero. In this manner, the bias voltage of the dimming controller 28 is galvanically isolated from the power source 12 of the solid state lighting apparatus 110.

Figure 14:
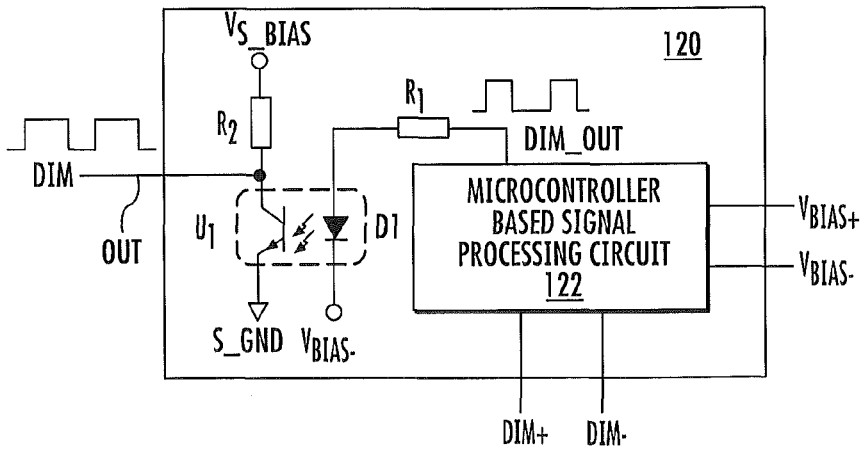
FIG. 14 is a schematic block diagram of a dimming controller according to some embodiments.

To achieve complete galvanic isolation of the dimming controller, the output of the dimming controller may also be isolated from the power source 12 in addition to having its bias power isolated from the power source 12. FIG. 14 is a block diagram of a dimming controller 120 that generates a dimming control signal DIM that is galvanically isolated from the bias voltage. The dimming controller 120 includes an opto-coupler $U_1$ including a light emitting diode and a photo-sensitive transistor, a microcontroller 122 and resistors $R_1$ and $R_2$ connected as shown in FIG. 14. The opto-coupler $U_1$ couples a dimming output signal DIM_OUT generated by a microcontroller 122 to an output line OUT. In particular embodiments, the microcontroller-based dimming control circuit generates a square-wave dimming control signal DIM_OUT, turning on/off the light-emitting diode $D_1$ in the opto-coupler $U_1$, therefore, turning on/off the photo-sensitive transistor in the same opto-coupler $U_1$, providing an isolated pulse width modulated (PWM)-type dimming control signal DIM to the DC/DC converter or Buck type converter. In this type of dimming control, the average LED current is proportional to $T_{ON}/(T_{ON}+T_{OFF})$, where $T_{ON}$ and $T_{OFF}$ are the turn-on time and turn-off time of the LEDs during one dimming control cycle, respectively.

Figure 15:
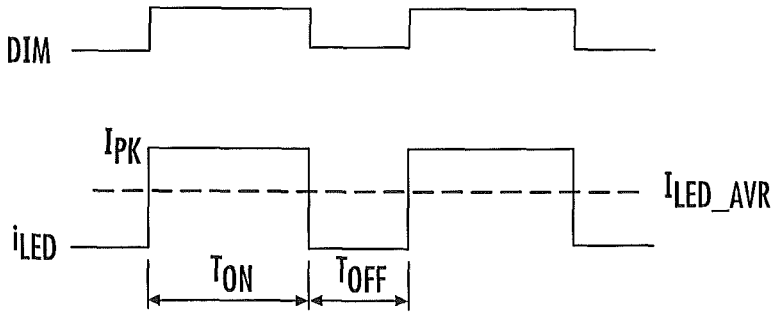
FIG. 15 is graph showing a dimming signal generated by a dimming controller according to some embodiments.

FIG. 15 shows an exemplary PWM dimming control signal and corresponding LED current waveforms. Since the brightness of LEDs is proportional to the average current, it can be adjusted by varying the duty cycle of the PWM dimming signal DIM, which is $T_{ON}/(T_{ON}+T_{OFF})$.

Figure 16:
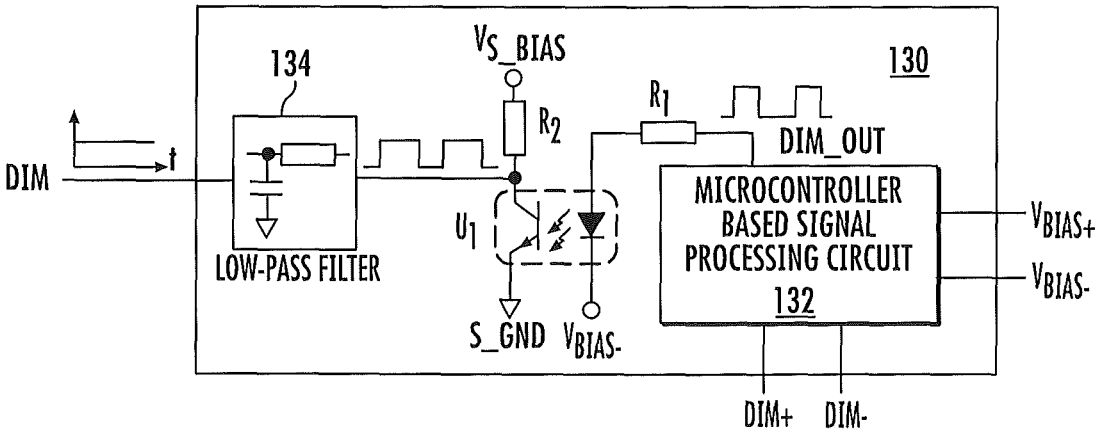
FIG. 16 is a schematic block diagram of a dimming controller according to further embodiments.

FIG. 16 shows yet another dimming control circuit 130 according to further embodiments. The dimming control circuit 130 of FIG. 16 generates an analog dimming signal DIM that has a value that can be varied in a linear fashion. Instead of the above described PWM-type dimming control signal provided for the main power converter to dim the LEDs, the signal at the output of the opto-coupler $U_1$ is further filtered via a low-pass filter 134, and generates a DC type control signal DIM, which has a level that is proportional to the duty cycle of the square wave waveform at the output of the opto-coupler $U_1$. The main converter regulates the LED current based on the level of signal DIM. The higher the level of the DIM signal is, the higher LED current the converter provides. In this way, the LED current is adjusted, and the brightness is varied. This type of dimming is referred to as linear dimming.

Figure 17A:
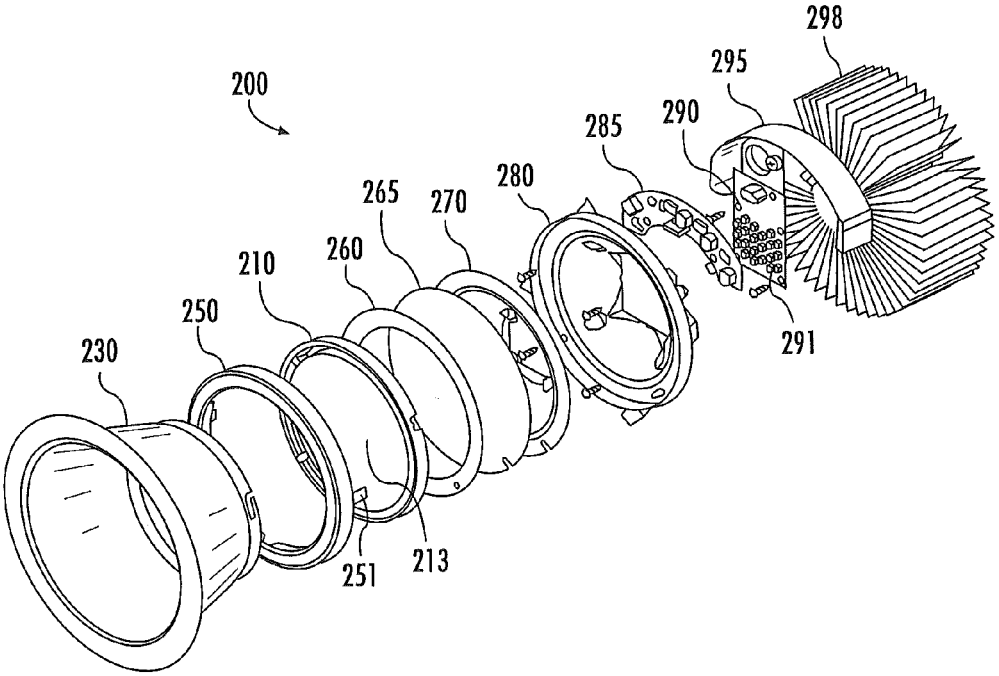
FIG. 17A is an exploded perspective view of a solid state lighting assembly including a light emitting diode driver circuit in accordance with some embodiments.
Figure 17B:
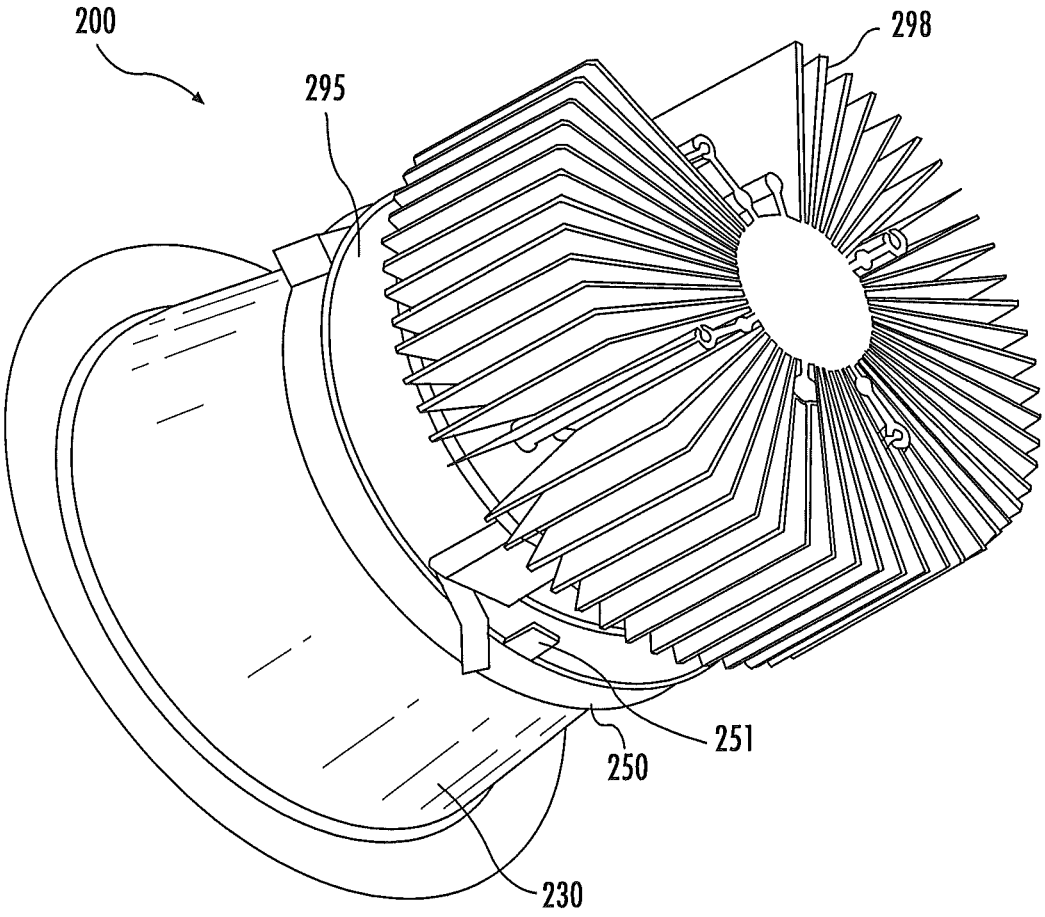
FIG. 17B is a perspective view of the solid state lighting apparatus of FIG. 17A in an assembled state.

FIG. 17A is an exploded perspective view of a solid state lighting apparatus 200 including a light emitting diode driver circuit in accordance with some embodiments, and FIG. 17B is a perspective view of the solid state lighting apparatus 200 of FIG. 17A in an assembled state. Referring to FIGS. 17A and 17B, a solid state lighting apparatus 200 includes an emitter board 290 on which an array of solid state light emitters 291 is mounted. The emitter board 290 is mounted within an emitter housing assembly including a base 295 and a main housing 280. Also mounted within the emitter housing assembly is a driver board 285 on which are mounted electronic components that provide LED driver circuitry as described herein for supplying drive current to the solid state light emitters 291.

An optional reflector cup 270 is mounted on the main housing 280. An optional diffuser 265 may be positioned over the reflector cup 270 and may be spaced apart from a lens assembly 210 including a central lens portion 213 by a gasket 260. A retention ring 250 may be provided over the lens assembly 210, and a trim structure 230 may be fastened to the retention ring 250.

A heatsink 298 may be arranged on the base 295 opposite the lens structure 210 to dissipate heat generated by the solid state light emitters 291. The retention ring 250 is arranged to cover an edge portion of the lens structure 210 and to maintain the lens structure 210, gasket 260, diffuser 265, and reflector cup 270 in a sandwiched relationship when a tab portion 251 of the retention ring 250 is mated with the main housing 280.

Embodiments of the present inventive concepts have been described herein with reference to the accompanying drawings. The inventive concepts may, however, be embodied in many different forms and should not be construed as limited to the embodiments set forth herein. Rather, these embodiments are provided so that this disclosure will be thorough and complete, and will fully convey the scope of the inventive concepts to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the disclosure. As used herein, the term "and/or" includes any and all combinations of one or more of the associated listed items.

The terminology used herein is for the purpose of describing particular embodiments only and is not intended to be limiting of the inventive concepts. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments and, although specific terms are employed, they are used in a generic and descriptive sense only and not for purposes of limitation, the scope of the inventive concepts being set forth in the following claims.

What is claimed is:

1. A light emitting diode (LED) driver that generates current for driving an LED load, comprising:

a voltage converter circuit that receives a power supply voltage and that supplies a drive current to the LED load in response to a control signal;

a control circuit that generates the control signal; and a bias voltage generating circuit that generates a bias voltage for powering the control circuit, wherein the bias voltage generating circuit is galvanically isolated from a power supply voltage and from the LED load.

2. The LED driver of claim 1, wherein the voltage converter circuit comprises a transformer having a primary winding and a secondary winding, and wherein the bias voltage generating circuit comprises a tertiary winding coupled to the primary and secondary windings through mutual inductance.

3. The LED driver of claim 2, wherein the bias voltage generating circuit comprises a diode having an anode coupled to a terminal of the tertiary winding and a bias capacitor coupled to a cathode of the diode, and wherein a voltage induced in the tertiary winding in response to a change in current through the secondary winding charges the bias capacitor through the diode to generate the bias voltage.

4. The LED driver of claim 3, wherein the voltage converter circuit comprises a second capacitor coupled to an input voltage and wherein the transibrmer comprises an inductor coupled between the second capacitor and the primary winding of the transformer.

5. The LED driver of claim 1, further comprising a power factor correction (PFC) circuit including a PFC inductor, wherein the bias voltage generating circuit comprises a bias winding coupled to the PFC inductor through mutual inductance, a diode coupled to a terminal of the bias winding, and a bias capacitor coupled to the diode, wherein a voltage induced in the bias winding in response to a change in current through the PFC inductor charges the bias capacitor through the diode to generate the bias voltage.

6. The LED driver of claim 1, wherein the control circuit comprises a dimming control circuit coupled to the voltage converter circuit that regulates a level of the drive current supplied to the LED load in response to a dimming input signal.

7. The LED driver of claim 6, wherein the dimming control circuit comprises an opto-coupler that galvanically isolates the dimming control circuit from the voltage converter circuit.

8. The LED driver of claim 7, wherein the dimming control circuit is configured to generate a pulse-width modulated digital dimming control signal.

9. The LED driver of claim 7, wherein the dimming control circuit is configured to generate an analog dimming control signal.

10. The LED driver of claim 6, further comprising an input configured to receive the power supply voltage and an occupancy sensor coupled to the dimming control circuit and configured to disconnect the input from the power supply voltage in response to an occupancy signal generated by the occupancy sensor.

11. The LED driver circuit of claim 1, wherein the LED driver includes both a primary and a secondary side circuit, and wherein the bias voltage generating circuit is galvanically isolated from both the primary and secondary side circuits of the LED driver.

12. The LED driver of claim 1, wherein the control circuit comprises a dimming control circuit, and the control signal comprises a dimming control signal.

13. A light emitting diode (LED) driver circuit that generates current for driving an LED load in response to control signal, comprising:

a voltage converter circuit configured to receive a power supply voltage and to supply a drive current to the LED load in response to the control signal;

a control circuit that generates the control signal and that is coupled to the voltage converter circuit; and a bias voltage generating circuit that generates a bias voltage for the control circuit, wherein the control circuit is galvanically isolated from both the voltage converter circuit and from the LED load.

14. The LED driver circuit of claim 13, further comprising a power factor correction (EEC) circuit coupled between the power supply voltage and the voltage converter circuit.

15. The LED driver circuit of claim 14, wherein the bias voltage generating circuit is galvanically isolated from the power supply voltage and the LED load.

16. The LED driver circuit of claim 15, wherein the bias voltage generating circuit comprises a bias winding that is coupled to a winding in the voltage converter circuit or the EEC circuit through mutual inductance.

17. The LED driver circuit of claim 13, wherein the control circuit comprises a dimming control circuit configured to generate the control signal that is used by the voltage converter circuit to regulate a level of the drive current supplied to the LED load.

18. The LED driver circuit of claim 17, wherein the dimming control circuit is optically isolated from the voltage converter circuit and from the LED load.

19. The LED driver circuit of claim 13, wherein the control circuit comprises a dimming control circuit, and the control signal comprises a dimming control signal.

20. A solid state light emitting apparatus, comprising:

a housing;

an emitter board comprising an LED load including a plurality of solid state light emitting devices within the housing;

a driver circuit within the housing and coupled to the plurality of solid state light emitting devices and configured to receive a power supply voltage and to generate current for driving plurality of solid state light emitting devices in response to a control signal, the driver circuit comprising a voltage converter circuit configured to supply a drive current to the plurality of solid state light emitting devices, a control circuit coupled to the voltage converter circuit and configured to generate the control signal that regulates a level of the drive current supplied to the LED load, and a bias voltage generating circuit that generates a bias voltage for driving the control circuit, wherein the bias voltage generating circuit is galvanically isolated from the driver circuit.

21. The solid state light emitting apparatus of claim 20, wherein the bias voltage generating circuit is galvanically isolated from the power supply voltage and from the LED load.

22. The solid state light emitting apparatus of claim 20, wherein the driver circuit includes both a primary and a secondary side circuit, and wherein the bias voltage generating circuit is galvanically isolated from both the primary and secondary side circuits of the driver circuit.

* * * * *